United States Patent [19]

Bass et al.

[11] 4,285,159

[45] Aug. 25, 1981

[54] DIRECTION REVERSING CRIB TOY

[75] Inventors: Sidney Bass, Los Angeles; John S. Cook, Redondo Beach; Herbert May, Torrance, all of Calif.

[73] Assignee: Mattel, Inc., Hawthorne, Calif.

[21] Appl. No.: 124,372

[22] Filed: Feb. 25, 1980

[51] Int. Cl.[3] ..... A63H 17/36; A63H 5/00; F16D 19/00; F16D 11/06

[52] U.S. Cl. ..... 46/262; 46/113; 46/212; 46/217; 46/112; 192/93 A; 192/21; 192/51

[58] Field of Search ..... 46/211, 212, 216, 1 K, 46/263, 260, 257, 259, 230, 231, 252, 262, 111-113, 217; 192/93 A, 21, 51

[56] References Cited

U.S. PATENT DOCUMENTS

| | | | |
|---|---|---|---|
| 669,500 | 3/1901 | Andrews | 192/21 |
| 1,547,517 | 7/1925 | Neff | 46/217 |
| 2,508,046 | 5/1950 | Smith | 192/21 |
| 2,774,182 | 12/1956 | Beder | 46/32 |
| 2,789,391 | 4/1957 | Perry | 46/32 |
| 3,041,983 | 7/1962 | Liversidge et al. | 46/113 |
| 3,331,153 | 7/1967 | Woods | 46/202 |
| 3,629,970 | 12/1971 | Baynes et al. | 46/111 |
| 4,189,038 | 2/1980 | Hurst | 192/93 A |

*Primary Examiner*—G. E. McNeill
*Assistant Examiner*—Michael J. Foycik
*Attorney, Agent, or Firm*—Reagin & King

[57] ABSTRACT

A crib toy having a shaped outer shell with a downward facing U-shaped aperture adapted to fit over a crib rail. The shell houses an automatic reversing mechanism which drives an output roller positioned in the aperture for moving the toy back and forth along the rail.

In a preferred embodiment, the reversing mechanism includes a motor which rotates first and second cam surfaces at a first speed and first and second cam followers at a second speed causing the cam followers to drive first and second gears to operate the output roller. The preferred embodiment combines a music box with the reversing mechanism to provide a synthesis of music and movement for a child.

4 Claims, 4 Drawing Figures

DIRECTION REVERSING CRIB TOY

BACKGROUND OF THE INVENTION

This invention relates to crib toys and, more particularly, to a mechanized crib toy adapted to move back and forth along the rail of a crib.

There have been many crib toys devised. Some of these crib toys are mechanized to perform various functions for entertaining a child. There have also been many toys devised in the prior art which include direction reversing mechanisms. For example, D. P. Clark U.S. Pat. No. 1,101,060, issued June 23, 1914; C. J. Neff U.S. Pat. No. 1,547,517, issued July 28, 1925; H. Muller U.S. Pat. No. 2,149,180, issued Feb. 28, 1939; and S. Asano U.S. Pat. No. 3,965,612, issued June 29, 1976, all disclose toy vehicles having various mechanical reversing mechanisms most of which are actuated by the vehicle reaching an impediment. Such mechanisms are used in toys for children who have developed manipulative ability.

As is well known, infants often follow repetitive motions for quite long periods. To date, however, there has been devised no practical toy with a reversing mechanism which may be utilized to provide repetitive motions for entertaining a child lying in a crib.

It is an object of the present invention to provide a new and improved crib toy.

It is another object of this invention to provide a crib toy having a unique direction reversing mechanism capable of moving a toy along the rails of a crib.

It is still another object of this invention to provide a new and improved crib toy capable of providing a melody while moving along the rail of a crib.

SUMMARY OF THE INVENTION

The foregoing and other objects of the invention are accomplished by a crib toy having an external shell with a downward facing U-shaped channel containing rollers for riding on a crib rail. The shell may be designed to emulate a well known object. Within the shell is positioned a motor adapted to provide power to an arrangement for driving one of the rollers in a first and in the opposite direction. The arrangement comprises three gears coaxially aligned, the first of which is rotated by the motor. The first and second gears have a different number of teeth and are linked by a pair of joined coaxially aligned gears also having a different number of teeth so that the first and second gears rotate at slightly different rates directly adjacent one another. A camming surface between the first and second gears causes them to separate when their angles of rotation have progressed to a particular angular difference (approximately 90° in a preferred embodiment). The movement of the second gear causes it to come in contact with and to rotate a gear actuating an output roller. The third gear is joined axially with the second gear, has the same number of teeth, and is adjacent a second camming surface identical to the first camming surface but rotated therefrom so that after the first and second gears have rotated through a sufficient angular difference with the second gear driving the output roller, the third gear is pressed into contact with the gear driving the output roller causing it to rotate in the opposite direction and the second gear is returned to its original position. In a preferred embodiment of the invention, a mechanical music box is connected to be operated by the motor driving the arrangement so that a melody such as a lullaby may be played while the crib toy moves backward and forward.

Other objects, features, and advantages of the invention will become apparent from a reading of the specification taken in conjunction with the drawings in which like reference numerals refer to like elements in the several views.

DESCRIPTION OF THE PREFERRED EMBODIMENT

Figure 1:
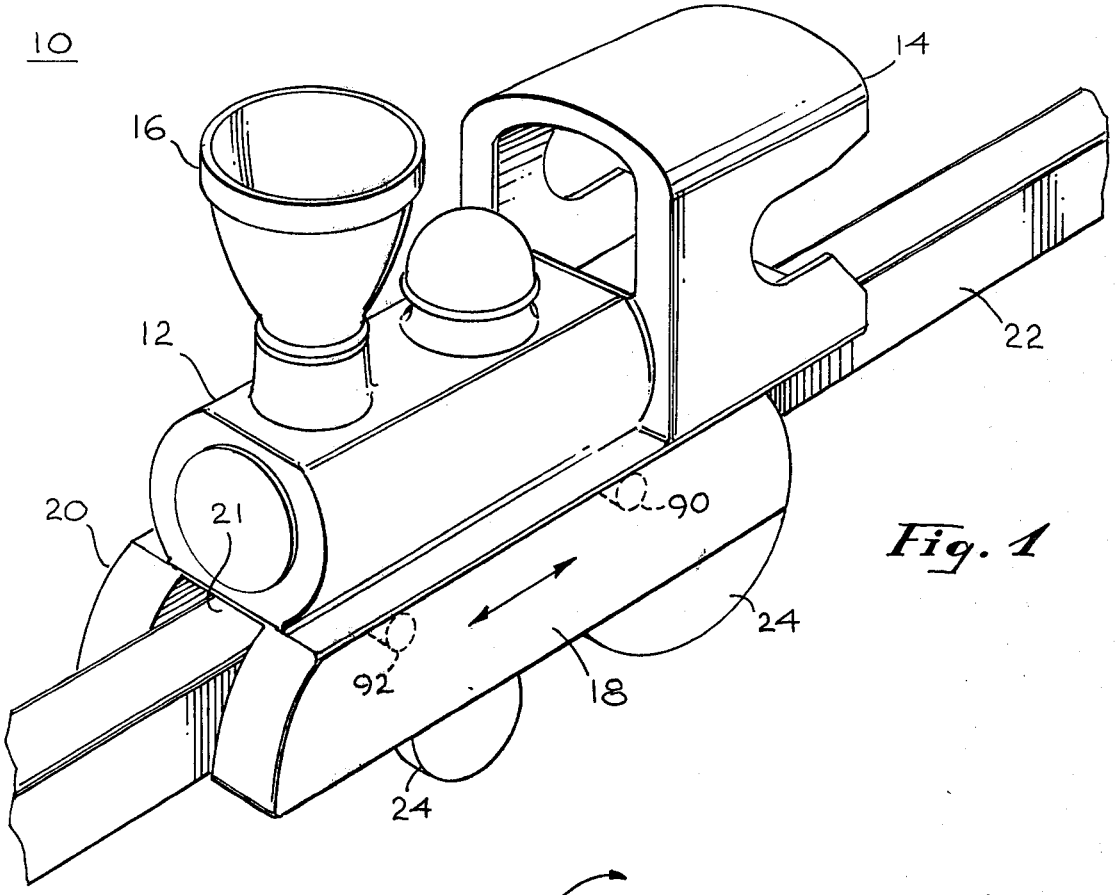
FIG. 1 is a perspective view of a crib toy constructed in accordance with the invention.

Referring now to the drawings and, more particularly, to FIG. 1, there is shown a child's crib toy 10 constructed in accordance with the invention. In the embodiment shown in FIG. 1, the crib toy 10 has an outer shell 12 shaped like a railroad locomotive. The shell 12 may be constructed of a moldable plastic material (such as high impact polystyrene) in a manner well known to the prior art. The shell 12 has at the right end (as shown in FIG. 1 ) a simulated cab 14 and mounts a smokestack 16 at its upper left end. In a preferred embodiment, the smokestack 16 is mounted to rotate a spring motor (not shown in FIG. 1) which drives the mechanism of the toy 10. The shell 12 is molded with depending rails 18 and 20 which provide a downward facing U-shaped channel 21 for holding the crib toy 10 in position upon a crib rail 22. Depending from the rails 18 and 20 are simulated wheels 24 which may also be molded from the plastic material as is the remainder of the shell 12. The various portions of the shell 12 may be molded in separate parts and joined together along seams, as is well known in the art.

In operation, the crib toy 10 is placed upon a rail 22 in the manner shown in FIG. 1; and the motor is actuated, either by winding the chimney 16 or, if not a spring motor, by other means, not shown. When released, the crib toy 10 progresses back and forth for a limited distance (approximately 0.5 meters in a preferred embodiment) along the rail 22 as shown in the arrow in FIG. 1. In a preferred embodiment, the crib toy 10 includes means for playing a melody while the toy 10 moves back and forth along the crib rail 22.

Figure 2:
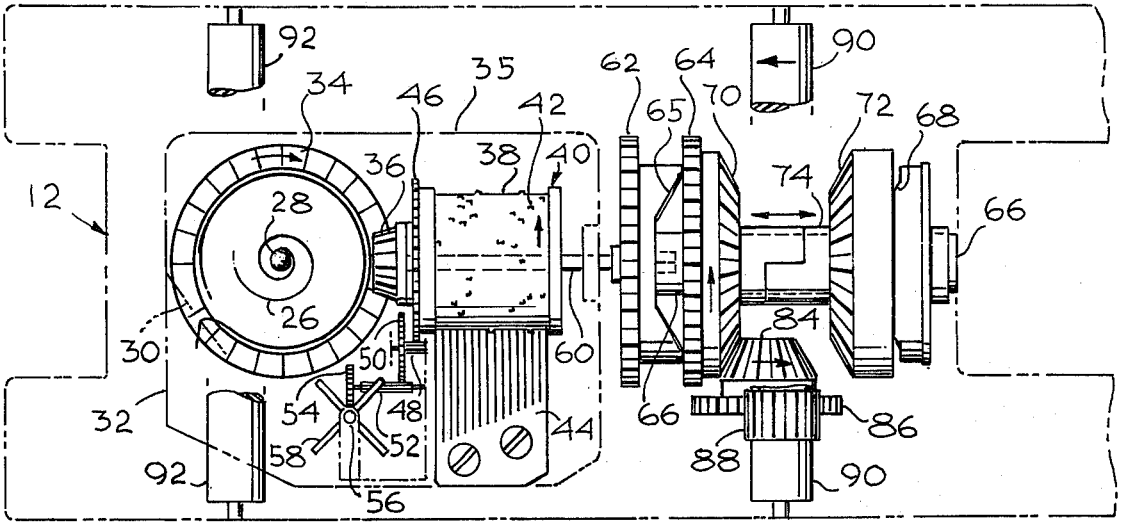
FIG. 2 is a bottom view of the crib toy shown in FIG. 1 with portions of the exterior shell removed to disclose the interior mechanism.
Figure 3:
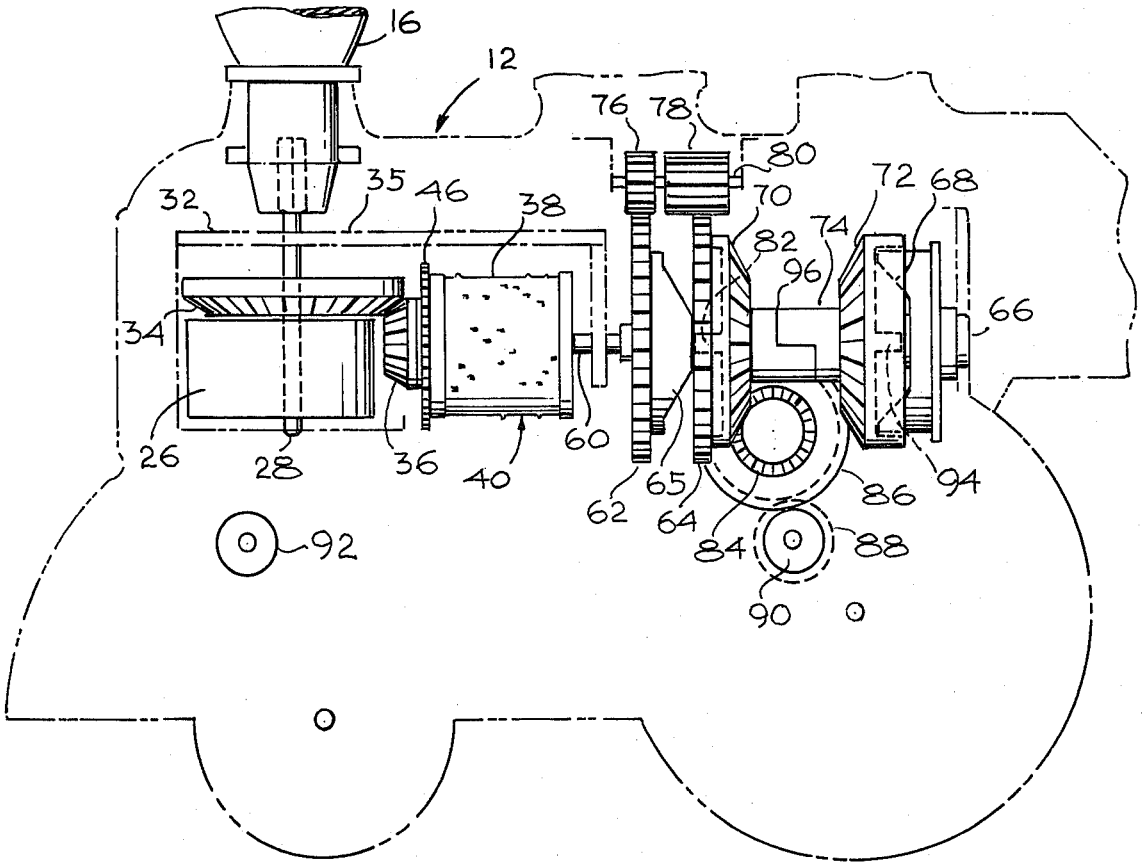
FIG. 3 is a side view of the interior mechanism of the crib toy shown in FIG. 2.

FIG. 2 and FIG. 3 show bottom and side views of the toy 10 with portions of the shell 12 removed to show a mechanism 25 which may be mounted within the toy 10 to move the crib toy 10 and to generate a musical melody. The mechanism 25 includes a spring motor 26 of a type well known in the art mounted to be wound upon an axle 28. The axle 28 is rotated by rotation of the chimney 16 (not shown in FIG. 2). The outer end of the spring of the spring motor 26 is secured by a retaining member 30 affixed to an inner housing 32 of the mechanism 25. When released after it has been wound by rotation of its axle 28, the motor 26 engages and rotates a gear 34 affixed thereto in the direction shown by the arrow in FIG. 2. The gear 34 meshes with and rotates a beveled gear 36 which is coaxially affixed to and rotates a cylindrical drum 38 of a music box assembly 40. The drum 38 has projections 42 extending outwardly therefrom which are arranged to lift individual tuned sounding members 44 as the drum 38 rotates (as shown by the arrow in FIG. 2) thereby playing a particular melody indicated by the positions of the projections 42 on the drum 38.

Figure 4:
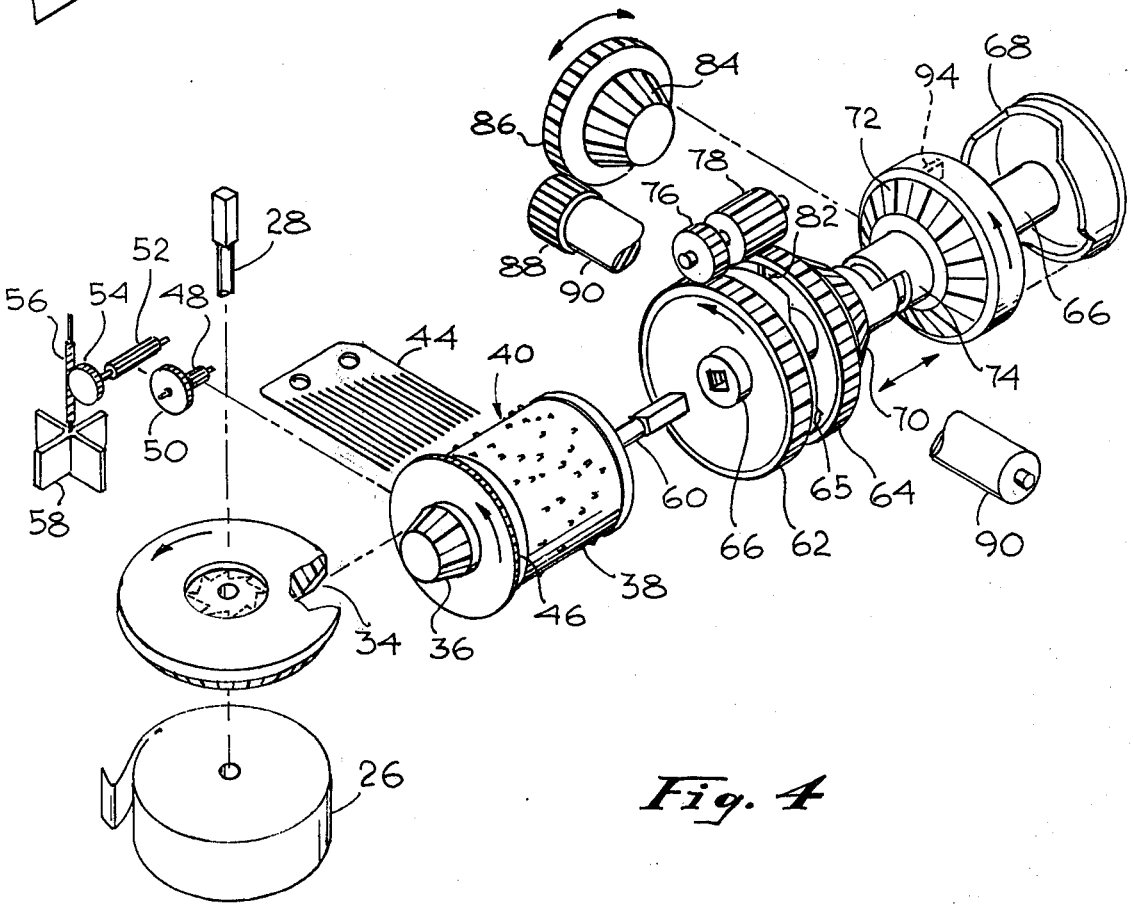
FIG. 4 is an exploded perspective view of the mechanism of the crib toy shown in FIGS. 1, 2, and 3.

Also fixed to and rotating with the drum 38 is a gear 46 which drives a spur gear 48. The spur gear 48 rotates a coaxially joined gear 50 to drive a second spur gear 52. Rotation of the spur gear 52 rotates a coaxially-joined gear 54 which drives a worm gear 56 thereby rotating a fan 58 which acts as a drag to limit the speed of the drum 38. A shaft 60 rotates with the drum 38 and is arranged to drive a gear 62. The gear 62 is arranged coaxially with a gear 64. The gear 62 has on its right-hand face (as shown in FIGS. 2, 3, and 4) a cam surface 65 directed to the right (as shown in FIG. 2). The gear 62 rotates upon an axle 66 to move a second cam surface 68 facing to the left (as shown in FIG. 2). The two cam surfaces 65 and 68 are each divided into four segments each occupying approximately a 90° sector about the axis of rotation. Opposite segments of each surface are at the same level and linked by short gradual slopes to the adjoining level. The cam surface 65 projects outward to the right where cam surface 68 is indented to the right.

A pair of gears 70 and 72 having identical bevel gear surfaces facing in opposite directions toward one another are arranged upon a shaft 74 which loosely surrounds the shaft 66 connecting the gear 62 to the cam surface 68. As may be better seen in FIG. 3 (which is a side view of the crib toy 10 shown in FIG. 1 with a side removed to better display the inner mechanism), the gears 62 and 64 are individually arranged to mesh with one of a pair of gears 76 and 78 which are connected together and rotate upon the same axle 80. The gears 62 and 64, however, are selected to have a different number of teeth. The gear 62 in a preferred embodiment has thirty-eight teeth while the gear 64 in the same embodiment has thirty-nine teeth. The gears 76 and 78 are also selected to have a different number of teeth. In the preferred embodiment, the gear 76 has twelve teeth and the gear 78 has eleven teeth. Consequently, as the gear 62 rotates through one complete revolution, it causes the gear 76 to rotate 38/12 revolutions. This drives the gear 78 to rotate 38/12 revolutions; but gear 78, in turn, rotates the gear 64 through only 11 times 38/12 teeth. Thus, while the gear 62 rotates one revolution, the gear 64 rotates through only just less than thirty-five teeth, less than a revolution. Since the shaft 74 is mounted to rotate freely upon the axle 66, the gear 64 rotates slightly with respect to the gear 62. The gear 64 has on its left-hand surface a pair of projections 82 which are adapted to follow the rightward facing cam surface 65 so that as the gears 62 and 64 are offset rotationally from one another the gear 64 will be driven to the right as the projections 82 are forced against the rightmost projecting part of the cam surface 65. As it is forced to the right, the gear 64 slides against the gear 78 and forces the gearface 70 against a beveled output gear 84. The output gear 84 rotates a connected gear 86 aligned on the same axis which drives a spur gear 88 connected to an output roller 90. A second free-wheeling roller 92 is affixed to the interior of the shell 12. When the gear 70 bears against the output gear 84 it rotates it in the direction shown in FIG. 2, causing the output roller to operate in the direction shown in FIG. 2 and move the cribe toy 10 to the right as shown in FIG. 2.

The crib toy 10 continues to the right until the projections 82 of the interior of gear 64 move beyond the rightward projecting portions of the cam surface 65. At this point, a pair of projections 94 upon the right face of the gear 72 which rotates with the gear 64 contact the leftmost portions of the cam surface 68 forcing the gear 72 to the left (as shown in FIGS. 2 and 3) and into contact with the surface of the output gear 84. This forces shaft 74 to the left at the same time withdrawing gear 70 from contact with the output gear 84. As gear 72 comes in contact with output gear 84, it reverses the direction of the rotation of the gear 84 to be opposite the direction of the arrow shown in FIG. 2. This causes the roller 90 to move opposite the direction of rotation shown in FIG. 2, and the crib toy 10 to move to the left as shown in FIG. 2.

In order to provide appropriate tolerances for the mechanism described herein, the shaft 74 which fits about the exterior of the shaft 66 is separated along a line 96 and is slotted so that there is some substantial amount of play between the gear surfaces 70 and 72.

In a preferred embodiment, the gears 34, 36, 62, 64, 70, 72; the cam surfaces 65 and 68; and the shafts 66 and 74 are constructed of a moldable plastic material such as Delryn. The fan 58 and the rollers 90 and 92 may also be constructed of a moldable plastic material such as Delryn. In a preferred embodiment, the roller 90 has an exterior tire which enchances the friction between the crib rail 22 and the roller 90 so that motion is easily imparted to the crib toy 10. The gears 46, 48, 50, 52, 54, and 56 may be constructed of metals well known to the art.

In operation, the spring motor 26 drives the drum 30 to provide a melody and rotates the gear 62 to place the gears 70 and 72 alternately in mesh with the output gear 84. This causes the output roller 90 and the crib toy 10 to be driven first in one direction and then in the opposite direction over a limited distance which in a preferred embodiment is approximately 0.5 meters. Such a crib toy 10 is very useful in entertaining a young child over a long period of time and is easily adapted to a variety of forms.

Thus, though there has been shown and described a preferred embodiment, various other embodiments and configurations will be obvious to those skilled in the art without departing from the spirit and scope of the invention.

What is claimed is:

1. A crib toy comprising an outer shell, a reversing mechanism housed in the shell, and means driven by the mechanism for moving the toy along a crib rail, wherein the reversing mechanism comprises a motor, a first cam surface rotated by the motor, a second cam surface rotated by the motor, a shaft, first and second gears positioned to rotate with the shaft, a first cam follower positioned adjacent the first cam surface and adapted to move the shaft, a second cam follower positioned adjacent the second cam surface and adapted to move the shaft, an output gear adapted to engage the second and third gears in different positions of the shaft, the output gear being connected to drive the means for moving the toy along a crib rail, and means for rotating the first and second cam surfaces at a different speed than the first and second cam followers.

2. A crib toy as claimed in claim 1 in which the means for rotating the first and second cam surfaces at a different speed than the first and second cam followers comprises a fourth gear rotating with the first cam surface, a fifth gear rotating with the first cam follower, and gear means linking the fourth and fifth gears whereby the fourth and fifth gears turn at different rates.

3. A crib toy as claimed in claim 2 in which the gear means linking the fourth and fifth gears comprise a pair of spur gears rotating on the same axis, the first gear of said pair engaging the fourth gear and having a first number of teeth, the second gear of said pair engaging the fifth gear and having a lesser number of teeth than the first gear of said pair, and the fourth gear has a lesser number of teeth than the fifth gear.

4. A crib toy as claimed in claim 3 further comprising means for producing a melody accompanying movement of the toy.

* * * * *

UNITED STATES PATENT AND TRADEMARK OFFICE

CERTIFICATE OF CORRECTION

PATENT NO. : 4,285,159

DATED August 25, 1981

INVENTOR(S) : Sidney Bass, John S. Cook, Herbert May

It is certified that error appears in the above-identified patent and that said Letters Patent are hereby corrected as shown below:

In claim 1, at column 4, lines 61 and 62, the words "the second and third gears" should read -- the first and second gears --.

Signed and Sealed this

*Eighteenth* Day of *January 1983*

[SEAL]

*Attest:*

GERALD J. MOSSINGHOFF

*Attesting Officer*

*Commissioner of Patents and Trademarks*